US005574441A

United States Patent [19]

Roes et al.

[11] Patent Number: 5,574,441

[45] Date of Patent: Nov. 12, 1996

[54] MASS TRANSIT INDUCTIVE DATA COMMUNICATION SYSTEM

[75] Inventors: John B. Roes, Kings Beach; Guy M. Kelly, La Jolla; Charles J. Ingram, La Mesa, all of Calif.

[73] Assignee: Cubic Automatic Revenue Collection Group, San Diego, Calif.

[21] Appl. No.: 87,994

[22] Filed: Jul. 2, 1993

Related U.S. Application Data

[63] Continuation-in-part of Ser. No. 633,063, Dec. 19, 1990, abandoned.

[51] Int. Cl.[6] ..... G08C 19/06

[52] U.S. Cl. ..... 340/870.31; 340/870.07; 340/870.32; 235/384; 232/7; 232/12

[58] Field of Search ..... 340/870.07, 870.31, 340/870.32, 825.54; 232/7, 12; 235/384; 364/405, 407

[56] References Cited

U.S. PATENT DOCUMENTS 4,372,478 2/1983 Gomez et al. ..... 232/12

4,758,836 7/1988 Scuilli ..... 340/870.31

*Primary Examiner*—John K. Peng
*Assistant Examiner*—Andrew Hill
*Attorney, Agent, or Firm*—Brown, Martin, Haller & McClain

[57] ABSTRACT

A transmitter circuit and a receiver circuit couple inductively to allow data communication between a mass transit vehicle farebox and an external computer. Data communication may be performed simultaneously with removal of coins from the farebox via a vacuum hose. Two mating connectors each carry a wire coil; one coil is connected to the transmitter circuit and the other is connected to the receiver circuit. Furthermore, the same connectors that carry the coils may be used to form the vacuum hose connection. A modulated signal representing encoded binary data is applied to the transmitter coil to cause corresponding flux changes. When placed in close proximity to one another, the magnetic flux changes across the gap induce a corresponding modulated signal in the receiver coil. The induced signal in the receiver coil is then decoded to recover the original binary data. The coils thus function as halves of a transformer.

5 Claims, 4 Drawing Sheets

MASS TRANSIT INDUCTIVE DATA COMMUNICATION SYSTEM

CROSS-REFERENCE TO RELATED APPLICATIONS

This application is a Continuation-In-Part of Ser. No. 07/633,063 filed Dec. 19, 1990 abandoned.

BACKGROUND OF THE INVENTION

The present invention relates generally to mass transit fare collection systems and, more specifically, to communication between a vehicle and a station terminal.

Many mass transit systems may have sophisticated data collection and analysis capability. Data in the form of fares collected, the destinations and times of use by patrons, and other information are collected from the transit vehicles and stations and analyzed at a central facility. The results are used to develop more responsive scheduling and allocation of equipment, detect and prevent revenue losses, plan maintenance and improvements, integrate with other transportation systems, and generally assist in the overall management of the transit system. Data is commonly also provided by the central facility to the transit vehicles and stations in the form of scheduling information, fare tables, blacklisted fare cards, and the like.

Data communication between a central facility having data analysis capability and stationary parts of the transit system, such as fare collecting turnstile systems, is commonly via permanent hard-wired lines connecting the station to a central computer system. Data communication between the central facility and mobile parts of the transit system, such as trolleys and buses, is more difficult if patrons do not pass through a stationary turnstile connected to the central facility. Typically, the fareboxes of such vehicles include electronic memories for storing data in addition to an electromechanical coin collection system. Periodically, it is necessary to transfer some of the data in the farebox memory, such as data concerning fares collected, to the central facility. It may also be necessary to update data in the farebox memory, such as data concerning scheduling and fare tables. Such data transfers may be performed daily.

When the transit vehicle returns to a central facility, the accumulated coins or tokens are removed from the farebox by a suction hose. At the same time, information may be transferred between the farebox and a computer at the facility. To establish the data link, a technician commonly maneuvers a cable into the vehicle and inserts the connector on the end of the cable into a mating connector on the farebox. Practitioners in the art have recognized that forming a good electrical connection is a problem because the facility is likely to be inhospitable to delicate electrical connectors. Grease and grime, soot from diesel engine exhaust, and even oils from the technician's perspiration may foul electrical contacts, resulting in unreliable data communication. Practitioners have reduced the effects of the harsh transit environment by using optical connectors. A transparent window at the end of each connector permits light from an infrared transmitter in one connector to be transmitted to an infrared receiver in the other connector. However, the two connectors must be carefully aligned to allow enough light transmission for reliable operation. In addition, the optical windows must be kept clean. Furthermore, the optical connectors are relatively fragile and must be handled carefully to avoid damage.

Since data communication is an increasingly important function in a transit system, there is a need for an improved data communication system and link from a transit vehicle to a central station. Such a system must be tolerant of misalignment of the connectors, must permit high data communication rates, and must be rugged and resistant to the harsh environment of a transit system. These problems and deficiencies are clearly felt in the art and are solved by the present invention in the manner described below.

SUMMARY OF THE INVENTION

The present invention comprises a transmitter circuit and a receiver circuit that couple inductively to allow data communication between a mass transit vehicle farebox and an external computer. Two mating connectors each have a wire coil; one coil is connected to the transmitter circuit and the other is connected to the receiver circuit. A modulated signal representing encoded binary data is applied to the transmitter coil to cause corresponding magnetic flux changes. When placed in close proximity to one another, the flux changes across the gap induce a corresponding modulated signal in the receiver coil. The induced signal in the receiver coil is then decoded to recover the original binary data. The coils thus function as halves of a transformer with an air core. However, each coil may itself may be wound on either a hollow (air core) form or a ferrite core.

The coding converts the binary data into a format that can be used to produce signal transitions. A suitable driver circuit converts the transitions into flux changes in the transmitter coil. Encoding the data into sequences of signal transitions is necessary because a receiver cannot otherwise distinguish individual bits in the data stream in the absence of a synchronizing clock signal. The coding may be any suitable type that represents a sequence of bits as a sequence of a greater or equal number of signal transitions. For example, Manchester encoding represents each bit with two logic states. Encoding known as "F2F" represents a binary "0" with a single logic state and a binary "1" with two logic states. A change of logic state generates a signal transition.

Each connector may have either one unidirectional or two coils for bidirectional communication. In embodiments where communication is bidirectional, data may be transferred from the farebox to the external computer by connecting the transmitter circuit to the farebox and the receiver circuit to the external computer. Data may be transferred from the external computer to the farebox by connecting the transmitter circuit to the external computer and the receiver circuit to the farebox.

In bidirectional embodiments, each connector has both a transmitter and a receiver coil or a single transmit receive/coil. In one arrangement, the transmitter coil and receiver coil of each connector are disposed in a side-by-side configuration with the transmitter coil of one connector aligned with the receiver coil of the other when the connectors are mated. Such an arrangement may be used for either half-duplex or full-duplex communication. If such an arrangement is used for full-duplex communication, however, interference (cross-talk) between the transmitter and receiver coils of a connector should be minimized by minimizing the gap between the connectors, shielding the coils, or a combination of both. Interference cannot occur if such an arrangement is used for half-duplex operation, and precise connector alignment and coil shielding are unnecessary.

In an alternate arrangement that can be used only for half-duplex communication, the transmitter and receiver coils of each connector are axially aligned in an back-to-back configuration. Although this arrangement cannot be used for full-duplex communication because there would be cross-talk between the adjacent transmitter and receiver coils, the arrangement is advantageous because it allows maximization of the coil diameter. A larger coil diameter increases the magnetic field strength, thereby increasing the tolerance of the system to misaligned connectors or connectors that are not fully engaged. The diameter of the coils is limited only by the size of the protective housing in which the coils are mounted.

An inductive data communication link has the important advantage that each coil and its associated circuitry may be enclosed in a sealed housing, and is therefore not adversely affected by external dirt or moisture, or even minor damage to the housing. The housing may be of any shape or type desirable, and the present approach may be used in conjunction with a vacuum system favored by many transit systems for extracting coins and tokens from the farebox. The coils are preferably oriented in a closely-spaced, well-aligned relation during data communication. However, the system is operable even with a relatively large gap between the coils and with significant misalignment. The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF THE PREFERRED EMBODIMENT

Figure 1:
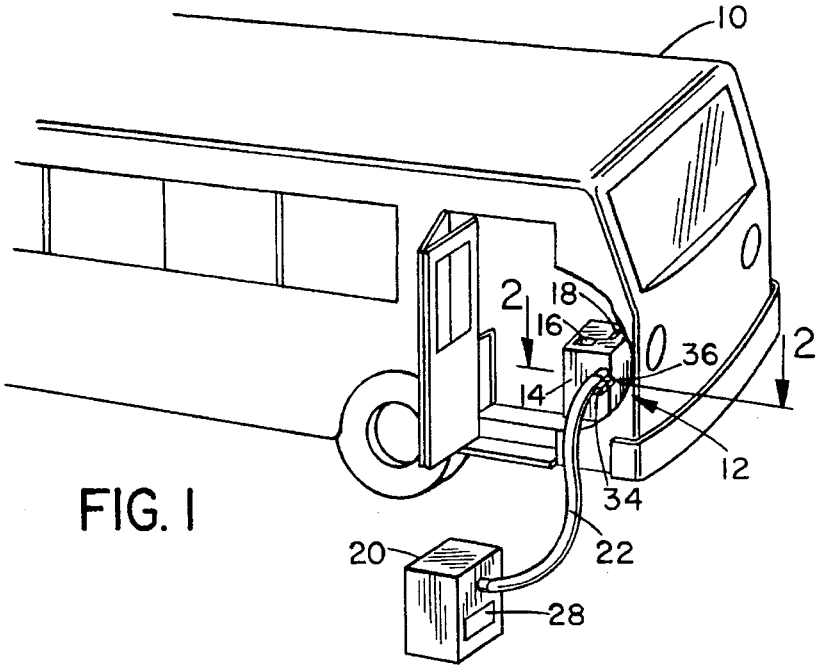
FIG. 1 is a perspective view, partially cut away for clarity, of a mass transit vehicle having a farebox, with an external communication link established.

In FIG. 1, a mass transit vehicle 10 has a vehicle fare data processing system 12, which includes a farebox 14. Farebox 14 accepts coins or tokens via a coin slot 16 or farecards via a farecard slot 18. In normal operation, admission to vehicle 10 is conditional upon payment of the correct fare, as determined by farebox 14. A suitable electronic computing system (not shown) in vehicle fare data processing system 12 determines the correct fares and accumulates data regarding fares paid and ridership according to known methods. Fare data processing system 12 may utilize pre-stored data such as fare tables as an input in performing its processing.

Periodically, such as at the end of a shift or other convenient time, vehicle 10 enters a central facility at which coins and tokens are removed from farebox 14 and information in fare data processing system 12 is accessed. A vehicle interface system 20 has a vacuum hose 22 that is connected to farebox 14 to remove coins and tokens by applying a powerful vacuum to the vault (not shown) in farebox 14 in which coins and tokens are accumulated. One end of vacuum hose 22 has a fitting 24 that mates with a receptacle 26 on farebox 14 to establish the vacuum connection. A half-turn or bayonet mount between fitting 24 and receptacle 26 is preferred, although other means for securing the vacuum connection, such as a threaded screw, are suitable. As known in the art, vacuum removal of coins and tokens is fast and minimizes loss due to accident or theft.

Figure 2:
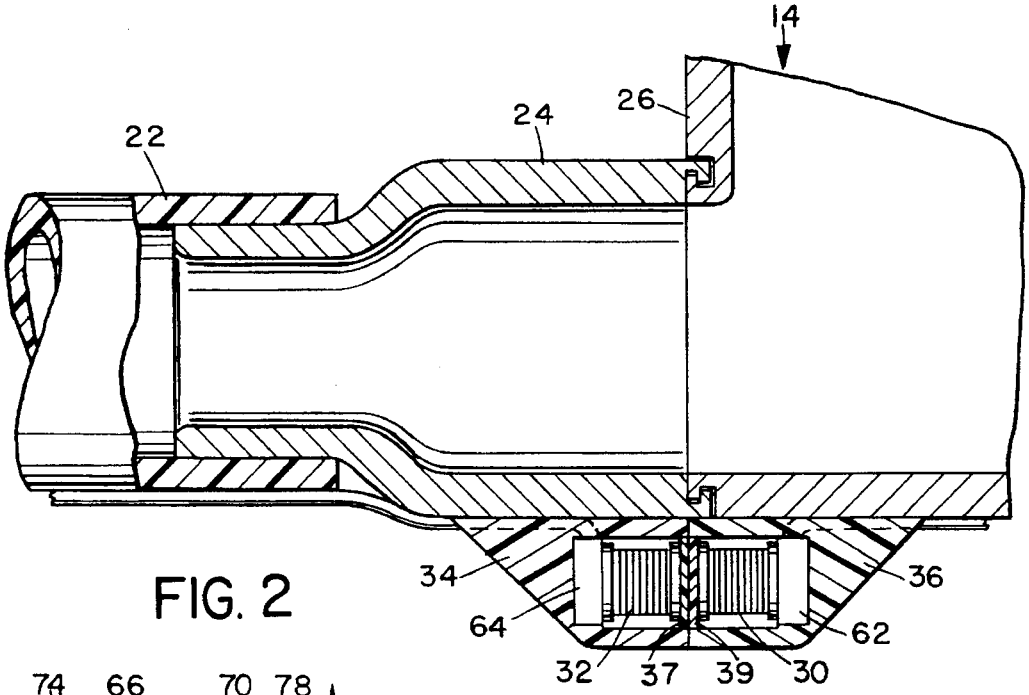
FIG. 2 is a partial sectional view of the interconnection that establishes both a vacuum connection and a data communication link, taken along line 2—2 of FIG. 1.

As shown in FIG. 2, while vacuum hose 22 is removing coins and tokens, data may be communicated unidirectionally or bidirectionally between vehicle fare data processing system 12 and an external fare data processing system 28. External fare data processing system 28 may be integral to vehicle interface system 20, as shown in FIG. 1, or may be a stand-alone unit. When fitting 24 is brought into close proximity with receptacle 26, a wire coil 30 adjacent receptacle 26 inductively couples with another wire coil 32 adjacent fitting 24. Projecting ears 34 and 36 attached to fitting 24 and receptacle 26, respectively, enclose coils 30 and 32 to protect them against damage. Alternatively, other suitable arrangements for protecting coils 30 and 32 may be provided. Fitting 24, ear 34, receptacle 26 and ear 36 are all made of a damage and shock resistant material such as an aluminum casting, and are therefore resistant to external damage such as dropping or even being run over by vehicle 10. Two protective covers 37 and 39, made of a suitable dielectric material, may be disposed at the ends of ears 34 and 36, respectively, to prevent damage to coils 32 and 30 and penetration of contaminants into ears 34 and 36. With a simple physical motion, comprising inserting fitting 24 into receptacle 26 and securing it, a technician (not shown) may simultaneously establish both the vacuum connection and the data communication link.

Figure 6:
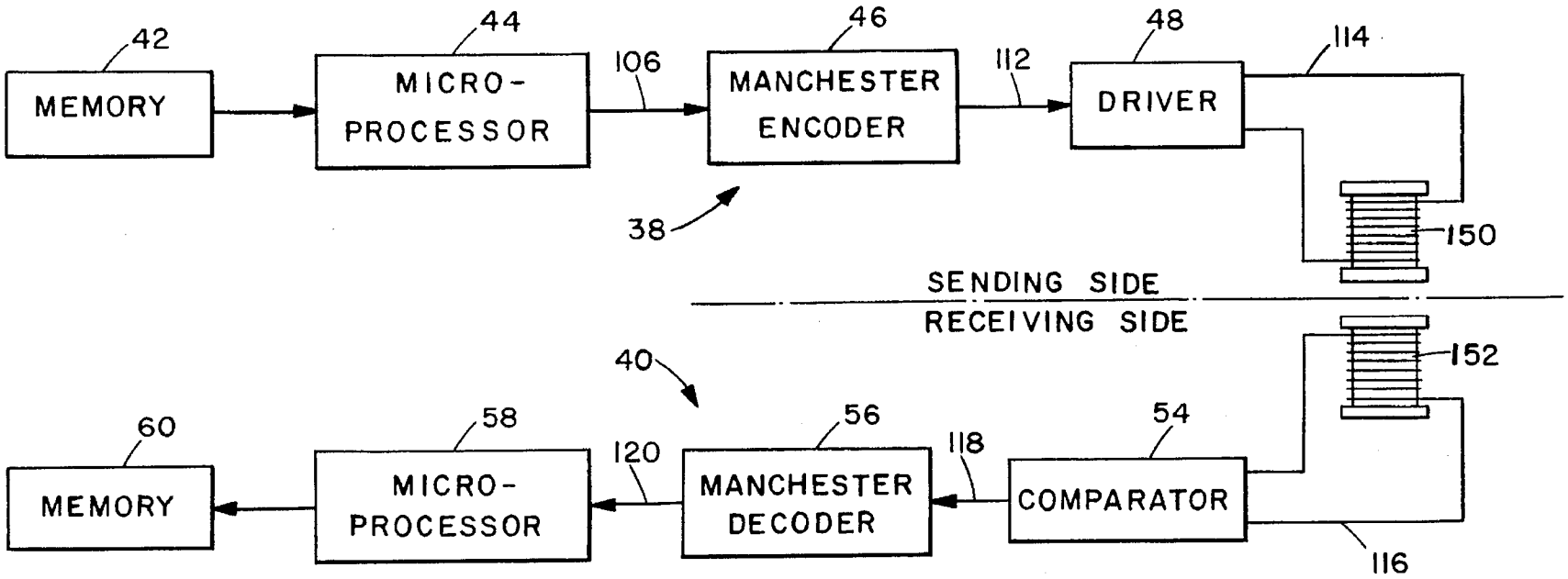
FIG. 6 is a schematic block diagram of the communication link electronics for unidirectional communication.
Figure 8:
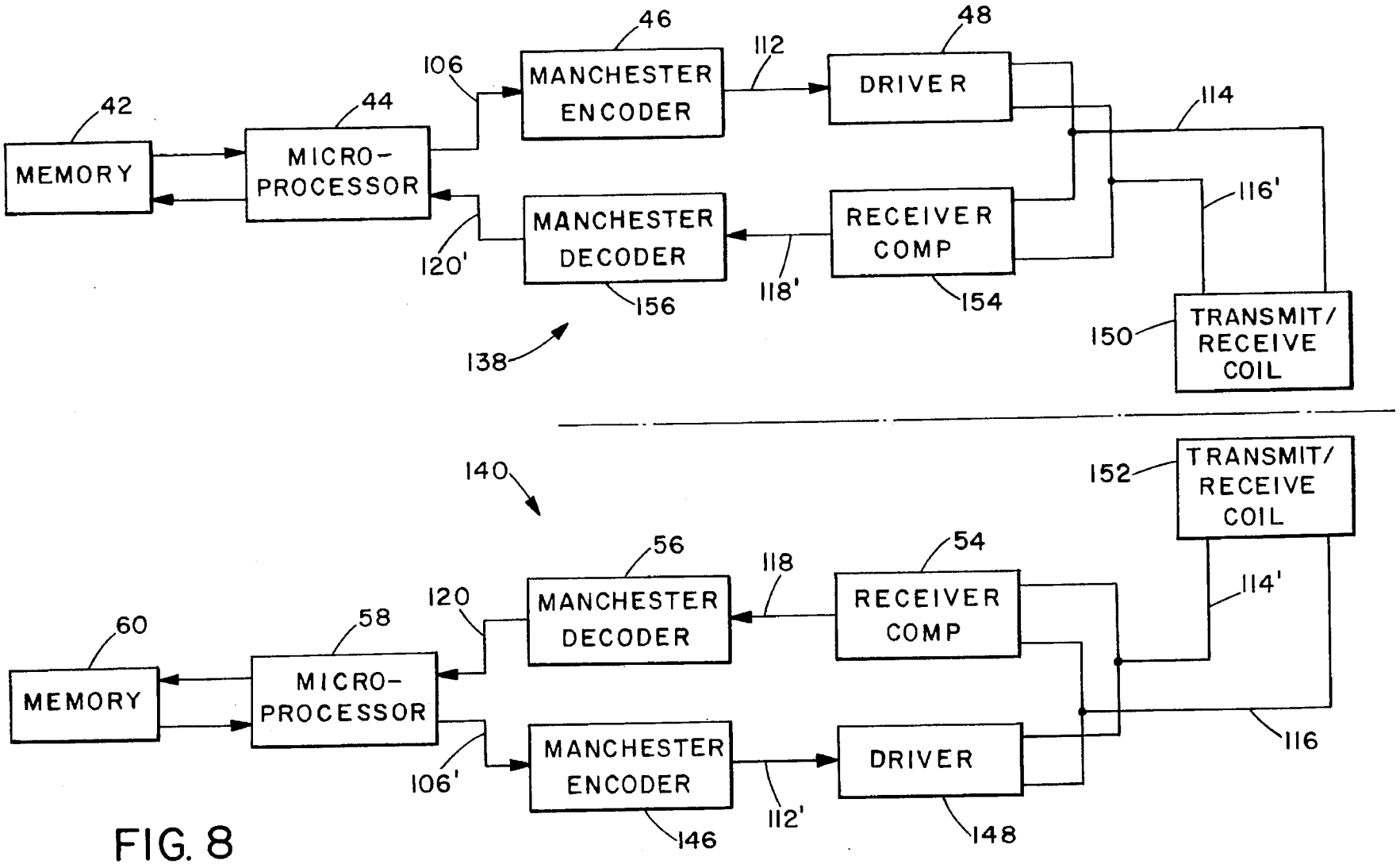
FIG. 8 is a schematic block diagram of the communication link electronics for bidirectional data communication.

The electronics of the inductive data communication system are shown in FIG. 6. The system comprises a transmitter circuit 38 and a receiver circuit 40. Although one transmitter circuit 38 and one receiver circuit 40 are sufficient for providing unidirectional data communication, a second transmitter circuit and a second receiver circuit may be included for providing bidirectional data communication, as illustrated in FIG. 8.

Transmitter circuit 38 comprises a memory 42, a processor 44, a Manchester encoder 46, a differential current driver 48, and a transmitter coil 50. Receiver circuit 40 comprises a receiver coil 52, a comparator circuit 54, a Manchester decoder 56, a processor 58, and a memory 60. FIG. 6 illustrates only the operation of the inductive data link and not the physical location of elements 42–60. In other words, transmitter circuit 38 may be disposed in vehicle fare data processing system 12, and receiver circuit 40 may be disposed in external fare data processing system 28 to transmit data from vehicle fare data processing system 12 to external fare data processing system 28. Conversely, transmitter circuit 38 may be disposed in external fare data processing system 28, and receiver circuit 40 may be disposed in vehicle fare data processing system 12 to transmit data from external fare data processing system 28 to vehicle fare data processing system 12. In embodiments of the former type, in which data is downloaded from vehicle 10, memory 42 and processor 44 may be that of vehicle fare data processing system 12, and memory 60 and processor 58 may be that of external fare data processing system 28. In embodiments of the latter type, where data is uploaded to vehicle 10, memory 42 and processor 44 may be that of external fare data processing system 28, and memory 60 and processor 58 may be that of vehicle fare data processing system 12. As discussed above, communication may be bidirectional in still other embodiments by providing duplicate circuitry to that of transmitter circuit 38 and receiver circuit 40, as illustrated in FIG. 8. In any embodiment, memories 42 and 60 and processors 44 and 58 may be used for other functions in addition to those described herein. For example, these processors may determine the correct fares to charge patrons, control the operation of coin and farecard mechanisms, collect revenue and ridership data, analyze collected fare data, and perform other functions on any information pertinent to fares commonly performed by mass transit systems. Alternatively, processors 44 and 58 may be dedicated processors used only for the functions described herein. Processors 44 and 58 may be of any suitable type, and may comprise microprocessors, discrete logic circuits, or programmable logic devices. Similarly, memories 42 and 60 may be any memories disposed in the above-described fare data processing systems that store information pertinent to fares. They may be used for other functions in addition to those described herein or to store other types of data in addition to that described herein. Transmitter circuit 38 and receiver circuit 40 are discussed in further detail below.

In some embodiments, data communication is unidirectional and in others it is bidirectional. As described above, the coil arrangement shown in FIG. 2 may be used to communicate unidirectionally in either direction between vehicle data processing system 12 and external data processing system 28. Ears 34 and 36 may enclose coil electronics 62 and 64 in addition to coils 30 and 32. Ears 34 and 36 may also contain energy absorbing material such as silicone rubber to minimize the possibility of damage to the coils and corresponding electronics from mechanical shock or differential expansion. In an embodiment in which the direction of data communication is from vehicle fare data processing system 12 to external fare data processing system 28, coil electronics 62 comprises driver 48 and coil electronics 64 comprises comparator circuit 54. Similarly, coil electronics 62 comprises comparator circuit 54 and coil electronics 64 comprises driver 48 when the direction of data communication is from external fare data processing system 28 to vehicle fare data processing system 12.

Figure 3A:
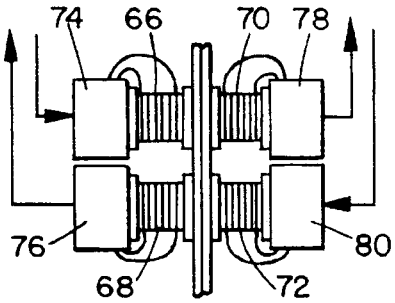
FIG. 3A shows a portion of an alternate embodiment of the communication link where each connector has two coils arranged in a side-by-side configuration.
Figure 3B:
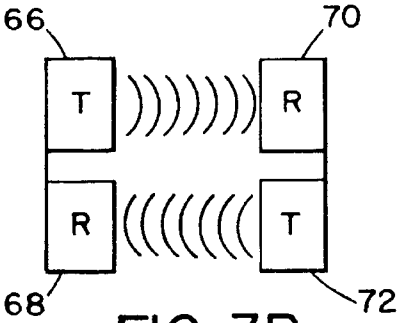
FIG. 3B is a block diagram of the communication link of FIG. 3A operating in a full-duplex mode.

Coil arrangements for embodiments in which data communication is bidirectional are shown in FIGS. 3A–B and 4A–B. Although not shown for clarity, each pair of coils shown in FIGS. 3A and 4A may be enclosed in an ear in a manner similar to that shown in FIG. 2. In FIG. 3A, a pair of coils 66 and 68 are disposed in a side-by-side arrangement and couple inductively with another pair of coils 70 and 72 that are also disposed in a side-by-side arrangement. Coils 66 and 72 may be coils such as transmitter coil 50 in FIG. 6, and may each be connected to a transmitter circuit 38. Coils 68 and 70 may be coils such as receiver coil 52 in FIG. 6, and may each be connected to a receiver circuit 40. When the connectors are brought into close proximity, coil 66 transmits data to coil 70, and coil 72 transmits data to coil 68, as shown in FIG. 3B. As described above with respect to FIG. 2, coils 66, 68, 70, and 72 may have corresponding coil electronics 74, 76, 78, and 80, respectively, and the coils and electronics may be mounted in energy absorbing material.

Figure 4A:
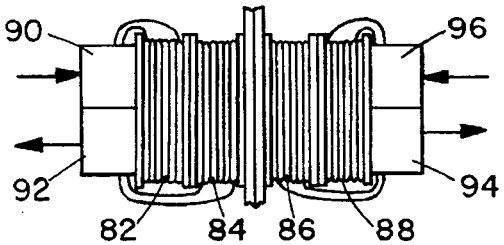
FIG. 4A shows a portion of another alternate embodiment of the communication link where each connector has two coils arranged in a back-to-back configuration.

In FIG. 4A, a pair of coils 82 and 84 are disposed in a coaxial or end-to-end arrangement and couple inductively with another pair of coils 86 and 88 that are also disposed in an end-to-end arrangement. Coils 82 and 88 may be coils such as transmitter coil 50 in FIG. 6, and may each be connected to a transmitter circuit 38. Coils 84 and 86 may be coils such as receiver coil 52 in FIG. 6, and may each be connected to a receiver circuit 40. As described above with respect to FIG. 3A, coils 82, 84, 86, and 88 may have corresponding coil electronics 90, 92, 94, and 96, respectively, and the coils and electronics may be mounted in energy absorbing material. When the connector halves are brought into close proximity, either coil 84 may transmit data to coil 86 or coil 88 may transmit data to coil 84. However, coils 82 and 88 cannot transmit simultaneously because they would interfere with one another. In other words, full-duplex operation is not possible because signals emanating from coil 82 would be received by coil 84, and signals emanating from coil 88 would be received by coil 86. Although only half-duplex operation is possible, the configuration of FIG. 4A may be advantageous because the diameters of coils arranged in an end-to-end configuration can be approximately twice those of coils arranged in a side-by-side configuration without a substantial increase in the size of the ear or other area in which the coil pair is enclosed. Maximizing the coil diameter increases the field strength and increases reliability of operation at greater gap widths and misalignments.

Figure 5:
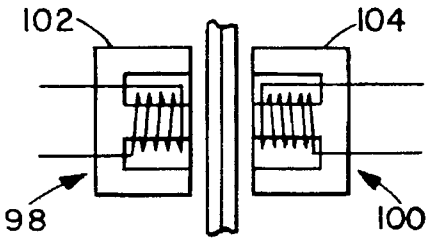
FIG. 5 shows coils wound on ferrite cores.

In FIG. 5, coils 98 and 100, comprising lengths of wire wound on ferrite cores 102 and 104, respectively, may be used as an alternative to any of coils 30, 32, 66, 68, 70, 72, 82, 84, 86, and 88, which comprise lengths of wire wound on hollow (air-core) spools or forms. Although ferrite cores 102 and 104 may have any suitable shape, they are preferably cup cores. A cup core is a well-known type of ferrite core comprising a cup-shaped body with a central spindle on which the wire is wound.

Figure 7:
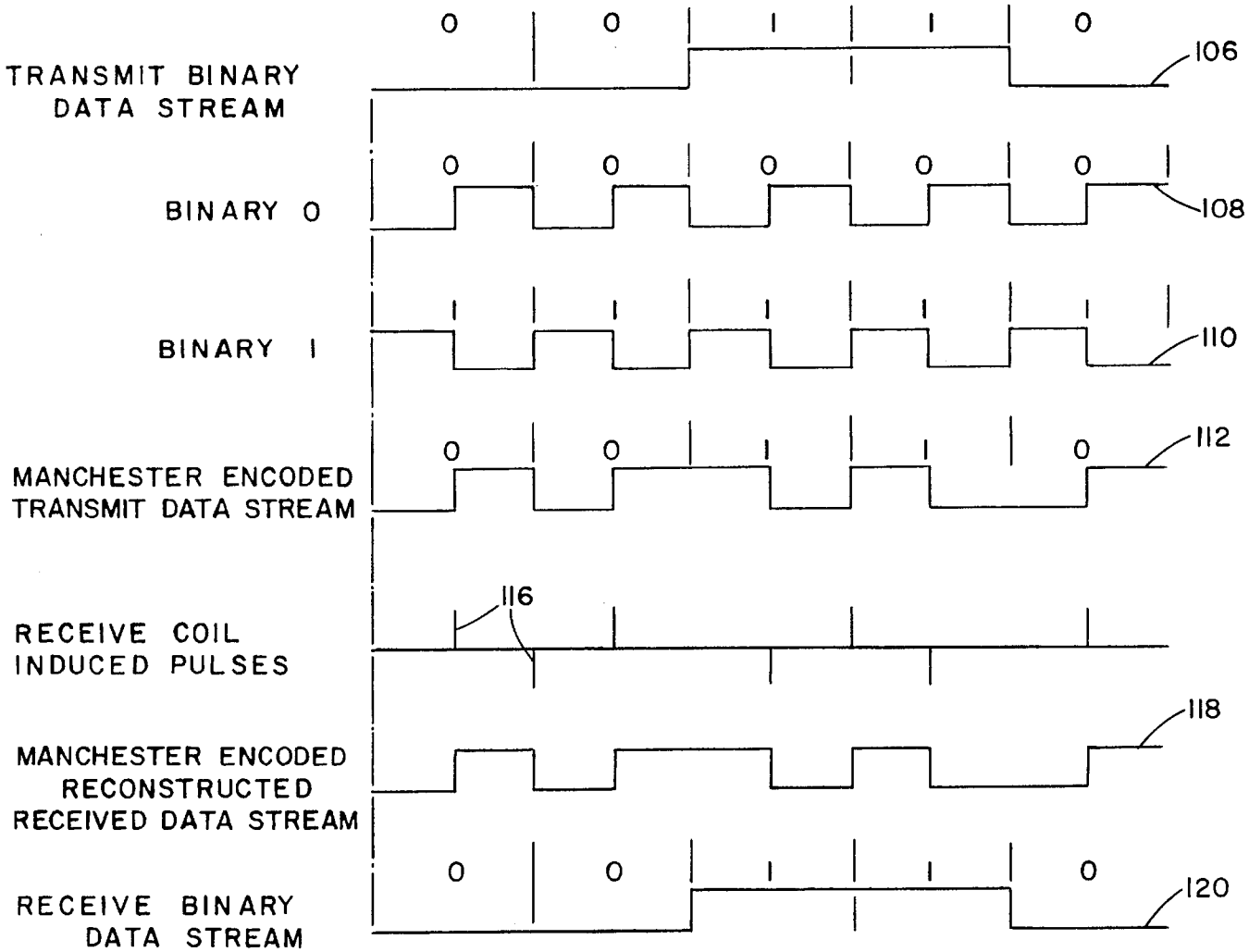
FIG. 7 is a timing diagram showing the relationship of signals in the communication link.

The operation of the inductive data communication system is now described with reference to FIGS. 6 and 7. As emphasized above, the circuitry of FIG. 6 may be used in any of several embodiments. Thus, in the following description, transmitter coil 50 represents any of coils 30, 66, 72, 82 and 88, and receiver coil 52 represents any of coils 32, 68, 70, 84 and 86.

Processor 44 serially retrieves binary input data 106 from memory 42. Manchester encoder 46 then encodes binary input data 106. Manchester encoding is described only briefly herein because it is well-known. Manchester encoder 46 internally maintains two 50 percent duty cycle digital signals 108 and 110, which are 180° out of phase. When input data 106 is a binary "0" Manchester encoder 46 produces an encoded signal 112 that is the same as signal 108 When input data 106 is a binary "1" Manchester encoder 46 produces encoded signal 112 that is the same as signal 110.

Differential current driver 48 receives encoded signal 112 and produces a current 114 in first direction when a high voltage (BINARY 1) is present at its input and a current 114 in the opposite direction when a low voltage (BINARY 0) is present at its input. Transmitter coil 50 receives current 114 and produces flux changes that correspond to the current changes. The flux changes induce corresponding current spikes or pulses 116 in receiver coil 52. A positive-feedback comparator circuit 54, latches pulses 116, thereby reproducing encoded signal 112 as reproduced encoded data 118. Manchester-decoder 56 decodes reproduced data 118 to reproduce binary input data 106 as reproduced binary input data 120. Processor 58 may then store the reproduced binary data 120 in memory 60 or use it to perform other operations.

Precise alignment between coils is not necessary for reliable data transmission because the magnetic signals can be received over significant gap widths. Transmission can be maintained with the coils separated by a gap width equal to as much as 100 percent of the coil diameter. Dirt or other contaminants between the connectors or simply the inattention of the technician who coupled them may result in only partial engagement of fitting 24 in receptacle 26. However, the present invention maintains reliable data transmission even though the gap width may be undesirably large or the coils considerably misaligned. Even significant amounts of dirt or other contaminants on the surfaces of ears 34 and 36 and covers 37 and 39 do not prevent data communication.

Figure 4B:
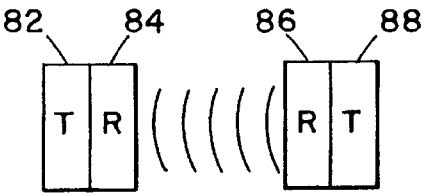
FIG. 4B is a block diagram of the communication link of FIG. 4A operating in a half-duplex mode.

FIG. 8 illustrates the electronics for a bidirectional data communication system utilizing any bidirectional coil arrangement, such as that of FIGS. 3A–B or that of FIGS. 4A–B. The circuit is similar to that of FIG. 6 and like reference numerals have been used where appropriate. However, whereas in FIG. 6 coil 50 is a transmit coil and coil 52 is a receive coil, in the embodiment of FIG. 8 coils 150 and 152 are both transmit/receive coils, and each of the two sides 138,140 of the circuit can both transmit and receive data.

Transmit/receive circuit 138 includes memory 42 and microprocessor 44. A first transmit circuit path from microprocessor 44 is provided via Manchester encoder 46 and differential current driver 48 to transmit/receive coil 150. Transmit/receive circuit 140 includes a first receive path from transmit/receive coil 152 via receive comparator 54 and Manchester decoder 56 to microprocessor 58 which is connected to memory 60. A second transmit path is provided from the microprocessor 58 back to the transmit/receive coil 152 via a second Manchester encoder 146 and a second differential current driver 148. A second receive path is provided in circuit 138 from transmit/receive coil 150 via second receive comparator 154 and second Manchester decoder 156.

With the arrangement illustrated in FIG. 8, data can flow from microprocessor 44 to microprocessor 58 exactly as described above in connection with FIG. 6. Alternatively, data can flow in the opposite direction from microprocessor 58 via Manchester encoder 146, driver 148, transmit/receive coil 152, transmit/receive coil 150, receive comparator 154, and Manchester decoder 156 back to microprocessor 44. It will be understood that the two circuit paths operate identically, and that Manchester encoder 146 and driver 148 of circuit 140 are equivalent to the Manchester encoder 46 and driver 48 of the other circuit 138, while Manchester decoder 156 and receive comparator 154 of circuit 138 are equivalent to Manchester decoder 56 and receive comparator 54. Thus, in a data flow path from microprocessor 58 to microprocessor 44, Manchester encoder 146 encodes binary input data 106' and produces encoded signal 112'. Encoded signal 112' is received by differential current driver 148 which produces current 114'. The resultant flux changes in transmit/receive coil 152 induce corresponding flux changes in transmit/receive coil 150, producing current pulses 116'. Receive comparator 154 reproduces the encoded signal 112' as reproduced encoded data 118'. Manchester decoder 156 decodes the reproduced data 118' to reproduce binary input data 106' as reproduced binary input data 120'.

Thus, the circuitry of FIG. 8 permits data flow in either direction between the microprocessors 44 and 58, allowing data communication from a transit vehicle to an external computer and back from the external computer to the transit vehicle.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A mass transit information communication system, comprising:

a first mechanical connector;

a second mechanical connector for mating with said first mechanical connector to form a mechanical connection, said mechanical connection for removing coins stored in a farebox through said first and second mechanical connectors;

first data transmitter means for providing sequences of first current changes in response to first transmitter input data;

a first inductive transformer half mounted on said first mechanical connector and connected to said first data transmitter means for providing sequences of first flux changes in response to said sequences of first current changes;

a second inductive transformer half mounted on said second mechanical connector for providing sequences of second current changes in response to said sequences of first flux changes, said first inductive transformer half and said second inductive transformer half being disposed such that they may be placed into sufficient proximity that each said first flux change may induce a corresponding second current change in said second inductive transformer half;

first data receiver means for providing first receiver output data corresponding to said first transmitter input data in response to sequences of said second current changes;

second data transmitter means for providing sequences of third current changes in response to second transmitter input data;

a third inductive transformer half mounted on said second mechanical connector and connected to said second data transmitter means for providing sequences of second flux changes in response to said sequences of third current changes;

a fourth inductive transformer half mounted on said first mechanical connector for providing sequences of fourth current changes in response to said sequences of second flux changes, said third inductive transformer half and said fourth inductive transformer half being disposed such that they may be placed into sufficient proximity that each said second flux change may induce a corresponding fourth current change in said second inductive transformer half; and first data receiver means for providing receiver output data in response to sequences of said fourth current changes.

2. The information communication system of claim 1, wherein said coins are removed from said farebox by a vacuum applied through both said first and said second mechanical connectors.

3. The information communication system of claim 1, wherein:

said first, second, third, and fourth inductive transformer halves each comprise a coil of wire wound on a dielectric form;

said coils of said first and fourth inductive transformer halves are axially aligned and disposed in an end-to-end arrangement; and said coils of said second and third inductive transformer halves are axially aligned and disposed in an end-to-end arrangement.

4. The information communication system of claim 3, wherein:

said first and fourth inductive transformer halves are disposed within a first sealed housing projecting from said first mechanical connector; and said second and third inductive transformer halves are disposed within a second sealed housing projecting from said second mechanical connector.

5. The information communication system of claim 4, wherein:

said first data transmitter means comprises:

a first Manchester encoder;

a first differential driver having an input connected to said first Manchester encoder and two outputs connected across said first inductive transformer half;

said second data transmitter means comprises:

a second Manchester encoder;

a second differential driver having an input connected to said second Manchester encoder and two outputs connected across said third inductive transformer half;

said first data receiver means comprises:

a first Manchester decoder;

a first comparator circuit having two inputs connected across said second inductive transformer half and an output connected to said first Manchester decoder;

said second data receiver means comprises:

a second Manchester decoder; and a second comparator circuit having two inputs connected across said fourth inductive transformer half and an output connected to said second Manchester decoder.

* * * * *